US011577123B1

(12) United States Patent
Saffaie et al.

(10) Patent No.: US 11,577,123 B1
(45) Date of Patent: Feb. 14, 2023

(54) GLUTE BRIDGE EXERCISE APPARATUS

(71) Applicants: Michael Saffaie, Redondo Beach, CA (US); Tao Xu, Stateline, NV (US)

(72) Inventors: Michael Saffaie, Redondo Beach, CA (US); Tao Xu, Stateline, NV (US)

( * ) Notice: Subject to any disclaimer, the term of this patent is extended or adjusted under 35 U.S.C. 154(b) by 9 days.

(21) Appl. No.: 17/481,000

(22) Filed: Sep. 21, 2021

(51) Int. Cl.

| | |
|---|---|
| ***A63B 23/04*** | (2006.01) |
| ***A63B 23/10*** | (2006.01) |
| ***A63B 23/02*** | (2006.01) |
| ***A63B 21/04*** | (2006.01) |
| ***A63B 21/055*** | (2006.01) |

(52) U.S. Cl.
CPC ..... *A63B 23/0482* (2013.01); *A63B 23/0205* (2013.01); *A63B 23/10* (2013.01); *A63B 21/0414* (2013.01); *A63B 21/0552* (2013.01); *A63B 2210/50* (2013.01)

(58) Field of Classification Search
CPC . A63B 23/0482; A63B 23/10; A63B 23/0205; A63B 23/0211; A63B 23/0233; A63B 2210/50; A63B 21/00058; A63B 21/00061; A63B 21/00065; A63B 21/04; A63B 21/0407; A63B 21/0414; A63B 21/055; A63B 21/0552; A63B 21/4009; A63B 21/4023; A63B 21/4027; A63B 21/4029
See application file for complete search history.

(56) References Cited

U.S. PATENT DOCUMENTS

| | | | | |
|---|---|---|---|---|
| D685,867 | S * | 7/2013 | Mehlman | A63B 21/4039 D21/687 |
| 9,737,750 | B2 * | 8/2017 | Garcia Lopez | A63B 21/0442 |
| 11,135,464 | B2 * | 10/2021 | Ballestero | A63B 21/0414 |
| 2013/0225378 | A1 * | 8/2013 | Burek | A63B 26/00 482/142 |
| 2020/0230464 | A1 * | 7/2020 | Kordecki | A63B 21/0552 |
| 2022/0118308 | A1 * | 4/2022 | Park | A63B 21/4039 |
| 2022/0219037 | A1 * | 7/2022 | Ho | A63B 21/4029 |

* cited by examiner

*Primary Examiner* — Megan Anderson
(74) *Attorney, Agent, or Firm* — Christopher J. Scott

(57) ABSTRACT

A glute bridge exercise apparatus enables a user to variously exercise glute muscle groups, and includes a first and second platform assemblies. The first platform assembly includes a first platform portion, a first peripheral frame, and a pair of first extension legs. The pair of first extension legs are telescopically receivable in and extensible from laterally opposed frame portions of the first peripheral frame. The second platform assembly includes a second platform portion, a second peripheral frame, and a platform support portion. A proximal frame end is pivotally attached to the first platform assembly adjacent the pair of first extension legs. The platform support portion is pivotally attached to a distal frame end and enables a user to adjust an angle of inclination of the second platform portion relative to the first platform portion for positioning the user between the first and second platform portions for variously exercising muscle groups.

17 Claims, 10 Drawing Sheets

GLUTE BRIDGE EXERCISE APPARATUS

FIELD OF THE INVENTION

The present invention relates generally to an exercise apparatus and more particularly to an exercise apparatus for enabling users thereof to exercise muscles associated with the Gluteus Maximus (glutes). The invention provides users with an apparatus for varying glute bridge exercises, a common exercise technique to exercise the particular muscle groups associated with the glutes.

BRIEF DESCRIPTION OF THE PRIOR ART

The Gluteus Maximus (glutes) and surrounding muscles (e.g. hamstring, vastus lateralis, etc.) are very popular muscle groups from aesthetic and sports performance perspectives. The glute muscles are commonly worked out using the glute bridge exercise performed when lying in a supine position with feet planted on the floor with the knees bent, and thrusting the hips into the air while engaging the buttocks muscles. The exercise may also be performed at a greater intensity by planting the feet on an elevated surface. Another method is the hip thrust performed while lying in a supine position with shoulders on an elevated surface higher than the planted feet and thrusting the hips into the air using the hip muscles. These methods of exercise, at various intensity levels, are generally performed using large or heavy pieces of equipment at gyms or health clubs.

Few portable pieces of equipment designed for the glute bridge and hip thrust exercises exist, leaving individuals to use leg extension machines, barbells, and other exercise equipment, which makes performing the exercises uncomfortable, a hassle or unsafe. Individuals may also perform the glute bridge on a flat surface using a resistance band by holding the band onto the floor while performing the glute bridge. This method of exercise can result in injury, however, if the user does not hold the resistance bands tight enough, and can be problematic for individuals with carpal tunnel syndrome, arthritis or other ailments and injuries. Even portable equipment used to perform glute bridges and hip thrusts can be bulky and difficult to store and transport. Portable equipment also does not enable a user to perform these exercises with feet elevated above the surface without requiring the use of additional equipment such as an exercise block.

For the foregoing reasons, the prior art perceives a need for an apparatus to safely perform glute bridge and hip thrust exercises at high intensity using resistance bands, that can be folded for optimal storage and transportation ease. Thus, there is a need for a lightweight, compact and foldable exercise apparatus that is specifically designed for both the glute bridge and hip thrust exercises, on a flat or elevated surface without the need for additional pieces of equipment, for frequent and convenient use at home or wherever the user may be.

SUMMARY OF THE INVENTION

To achieve the foregoing and other readily apparent objectives, the present invention may be said to essentially teach or disclose a glute bridge exercise apparatus. The glute bridge exercise apparatus according to the present invention comprises first and second platform assemblies, one of which is designed for support upon a planar support surface in substantially parallel relation thereto, and the second of which is pivotally attached to the first and configured for altering an angle of inclination of a second support platform relative to a first support platform of the first platform assembly. The first platform assembly may further comprise extensible legs for selectively distancing the second platform assembly relative to the first platform assembly.

More particularly, the first platform assembly may be said to essentially comprise a first platform portion, a first peripheral frame extending about the periphery of the first platform portion, and a pair of first extension legs. The pair of first extension legs are telescopically receivable in and extensible from laterally opposed frame portions of the first peripheral frame. The second platform assembly may be said to essentially comprise a second platform portion, a second peripheral frame extending about the periphery of the second platform portion, and a platform support portion.

The second peripheral frame has a proximal frame end and a distal frame end. The proximal frame end is pivotally attached to the first platform assembly adjacent the pair of first extension legs. The platform support portion is pivotally attached to the distal frame end and enables a user to adjust an angle of inclination of the second platform portion relative to the first platform portion. The user is able to position portions of his or her anatomy between the first and second platform portions for variously exercising (glute) muscle groups.

The glute bridge exercise apparatus according to the present invention may further preferably comprise a primary cross member of the first platform assembly whereby the cross member interconnects the pair of first extension legs for stabilizing and maintaining a fixed distance between the pair of first extension legs at the preferred angle of inclination. The proximal frame end of the second peripheral frame is preferably pivotally attached to the cross member of the first platform assembly thereby providing a singular first pivot axis of rotation.

The first peripheral frame preferably comprises a first frame width, the second peripheral frame preferably comprises a second frame width, and the platform support portion preferably comprises a support portion width. The second frame width is lesser in magnitude than the first frame width, and the support portion width is lesser in magnitude than the first frame width, but greater in magnitude than the second frame width. The first peripheral frame further preferably comprises a first frame length, the second peripheral frame further preferably comprises a second frame length, and the platform support portion further preferably comprises a support portion length such that the second frame length and the support portion length are each lesser in magnitude than the first frame length. These structural arrangements allow for a compact stowage arrangement of the glute bridge exercise apparatus when in a folded, collapsed configuration, which further eases portability of the apparatus.

In this last regard, a key feature of the glute bridge exercise apparatus according to the present invention is that the second platform assembly is foldable into a collapsed configuration. The folded, collapsed configuration of the second platform assembly is restable in adjacency to or atop the first platform portion when the pair of first extension legs are telescopically received in the laterally opposed portions of the first peripheral frame. The first and second platform assemblies are substantially parallel to one another when in the collapsed configuration for enhancing stowability and portability of the glute bridge exercise apparatus.

The glute bridge exercise apparatus according to the present invention may further provide at least one extension leg of the pair of first extension legs that comprises a series of pin-receiving apertures and at least one of the laterally opposed frame portions of the first peripheral frame is outfitted with a (spring-biased) pin mechanism. The pin mechanism is cooperable with the series of pin-receiving apertures for enabling the user to selectively lock the at least one of the pair of first extension legs in a telescopically extended state relative to the at least one of the laterally opposed frame portions for selectively distancing the second platform assembly relative to the first platform assembly as, for example, to accommodate users of differing heights or to vary the distance between opposed support portions for varying exercise support point distancing.

The first platform assembly may further preferably comprise a pair of laterally opposed raised ring attachment features, which raised ring attachment features extend upwardly from the first peripheral frame orthogonally relative to the substantially planar first platform assembly. The platform support portion and the cross member may each also comprise a ring attachment feature. The ring attachment feature of the platform support portion opposes the ring attachment feature of the cross member for enabling the user to interconnect the platform support portion and the cross member with an angle maintenance element or feature for maintaining the angle of inclination of the second platform portion relative to the first platform portion.

The glute bridge exercise apparatus according to the present invention may further preferably comprise a collapsed configuration locking mechanism for locking the second platform assembly in adjacency to the first platform portion when in the collapsed configuration and preventing the second platform assembly from unfolding relative to the first platform assembly during transportation. The collapsed configuration locking mechanism is exemplified by the cooperative association a pin and axially aligned pin-receiving apertures formed in the platform support portion and the cross member. The glute bridge exercise apparatus may further preferably comprise a handle portion that extends intermediate the first platform portion and the first peripheral frame at an upper end of the first platform assembly for enabling the user to hand carry the glute bridge exercise apparatus.

BRIEF DESCRIPTIONS OF THE DRAWINGS

Other features and objectives of the invention will become more evident from a consideration of the following brief descriptions of patent drawings.

DETAILED DESCRIPTION OF THE PREFERRED EMBODIMENTS

Figure 1:
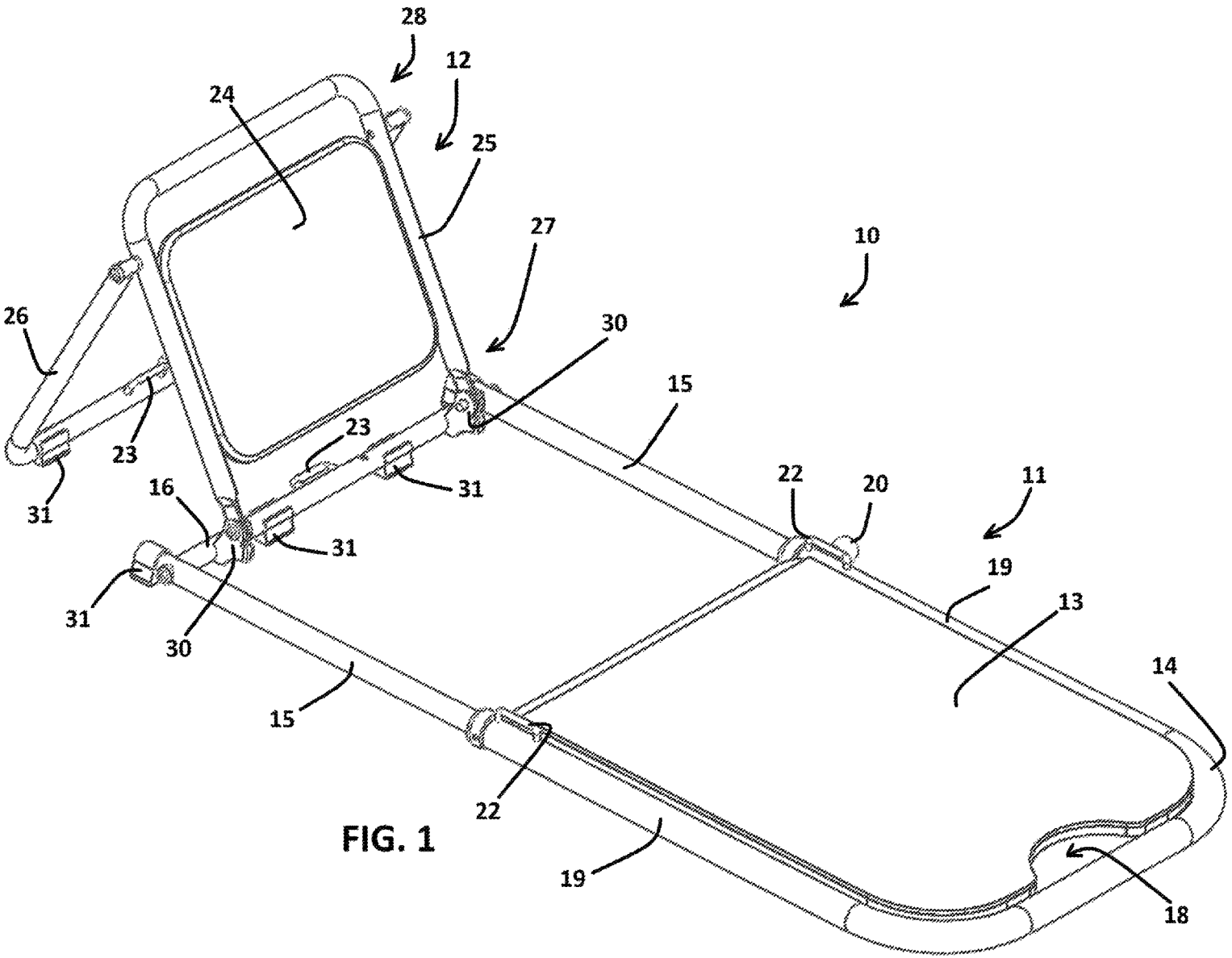
FIG. 1 is a first perspective view of the glute bridge exercise apparatus according to the present invention shown in an extended first state of use.
Figure 2:
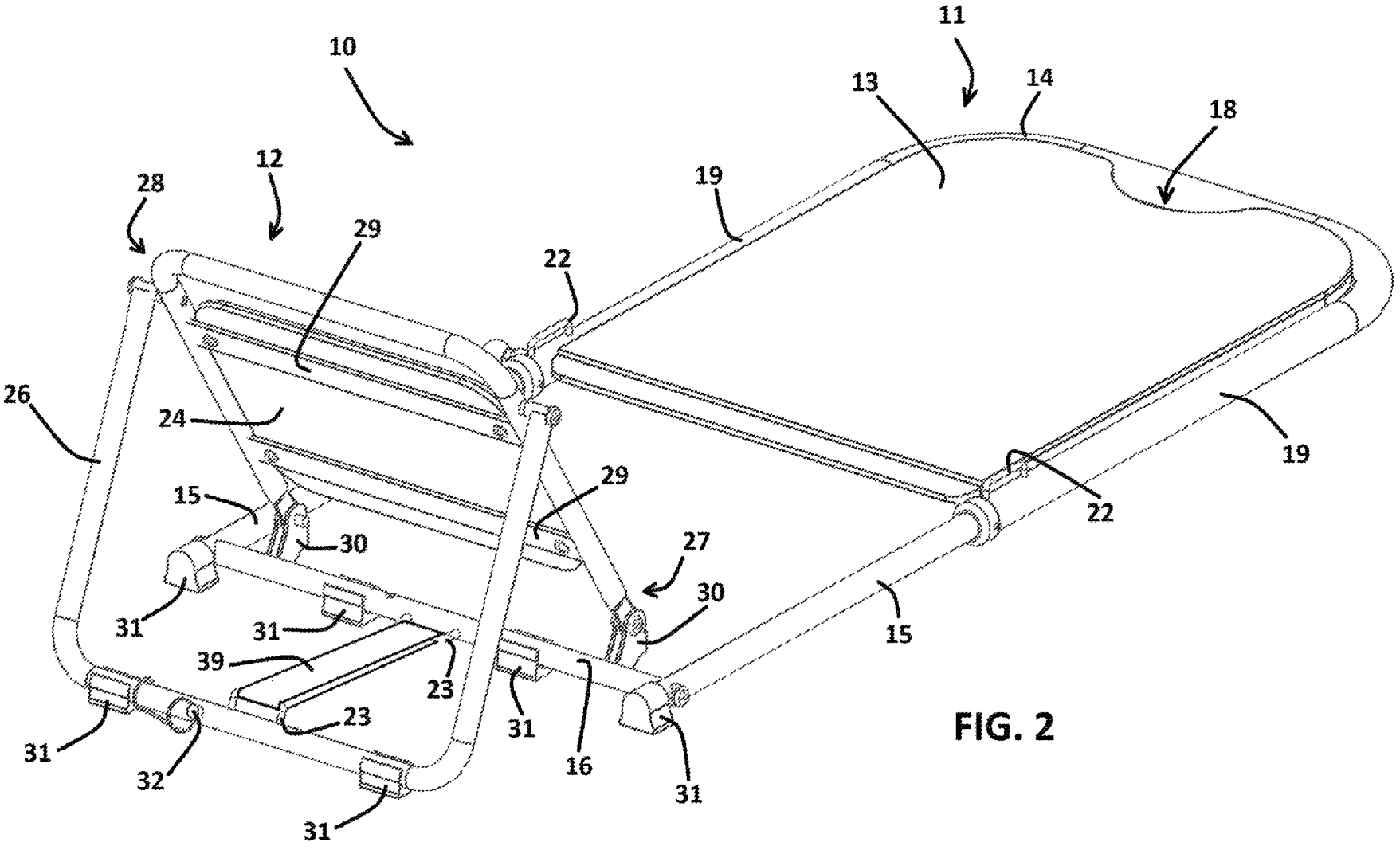
FIG. 2 is a second perspective view of the glute bridge exercise apparatus according to the present invention shown in the extended first state of use.
Figure 3:
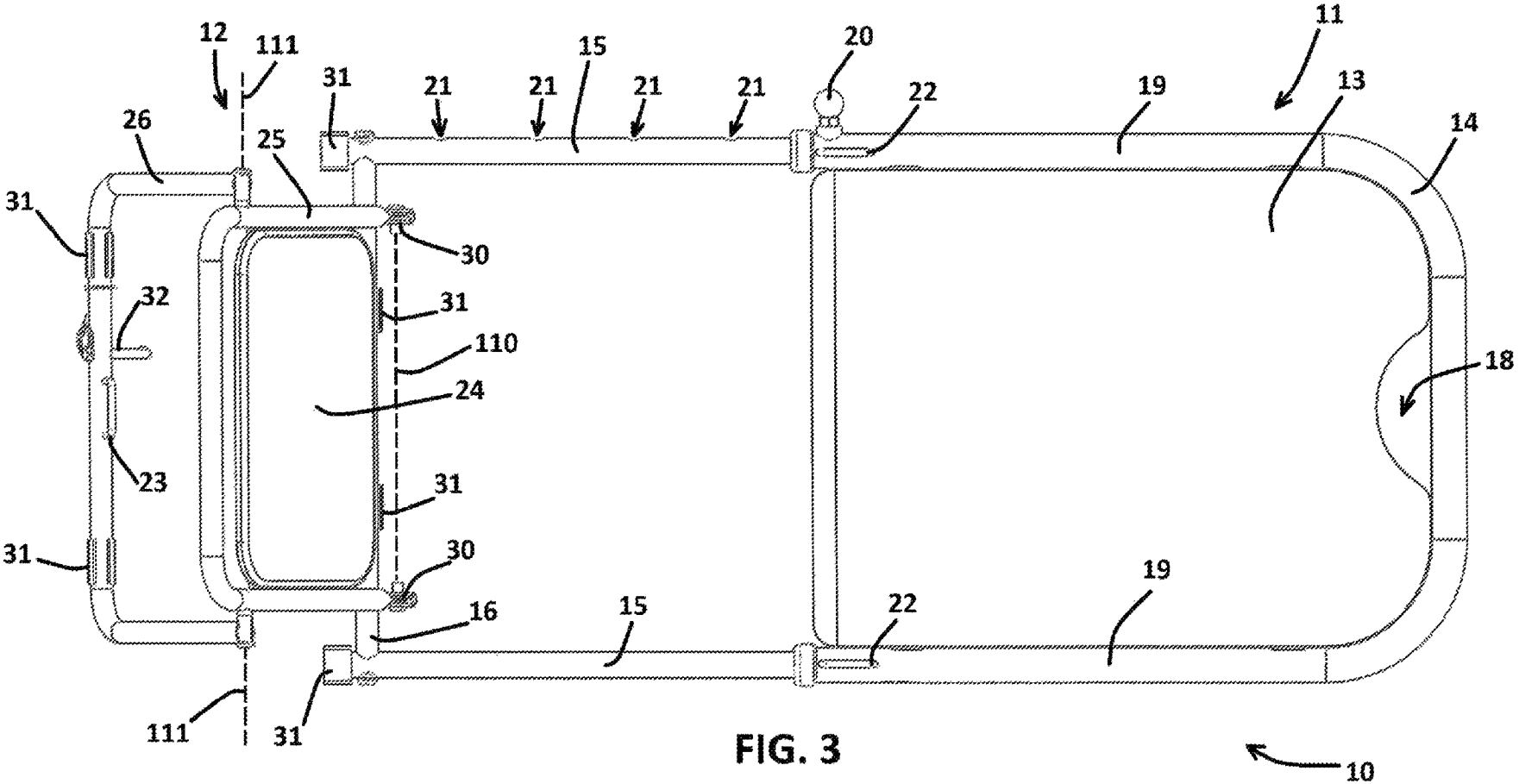
FIG. 3 is a top plan view of the glute bridge exercise apparatus according to the present invention shown in the extended first state of use.

Embodiments of systems, components, and methods of assembly and manufacture will now be described with reference to the accompanying figures. Although several embodiments, examples, and illustrations are disclosed below, it will be understood by those of ordinary skill in the art that the embodiments described herein extend beyond the specifically disclosed configurations, examples, and illustrations, and can include other users of the disclosure and obvious modifications and equivalents thereof. The terminology used in the descriptions presented herein is not intended to be interpreted in any limited or restrictive manner simply because it is being used in conjunction with a detailed description of certain specific embodiments of the disclosure. In addition, embodiments of the disclosure can comprise several novel features and no single feature is solely responsible for its desirable attributes or is essential to practicing any one of the several embodiments herein described.

Certain terminology may be used in the following description for the purpose of reference only, and thus are not intended to be limiting. For example, terms such as "above" and "below" refer to directions in the drawings to which reference is made. Terms such as "front," "back," "left," "right," "rear," "top," "bottom" and "side" describe the orientation and/or location of portions of the components or elements within a consistent but arbitrary frame of reference which is made clear by reference to the text and the associated drawings describing the components or elements under discussion. Moreover, terms such as "first," "second," "third," and so on may be used to describe separate components. Such terminology may include the words specially mentioned above, derivatives thereof, and words of similar import.

Figure 4:
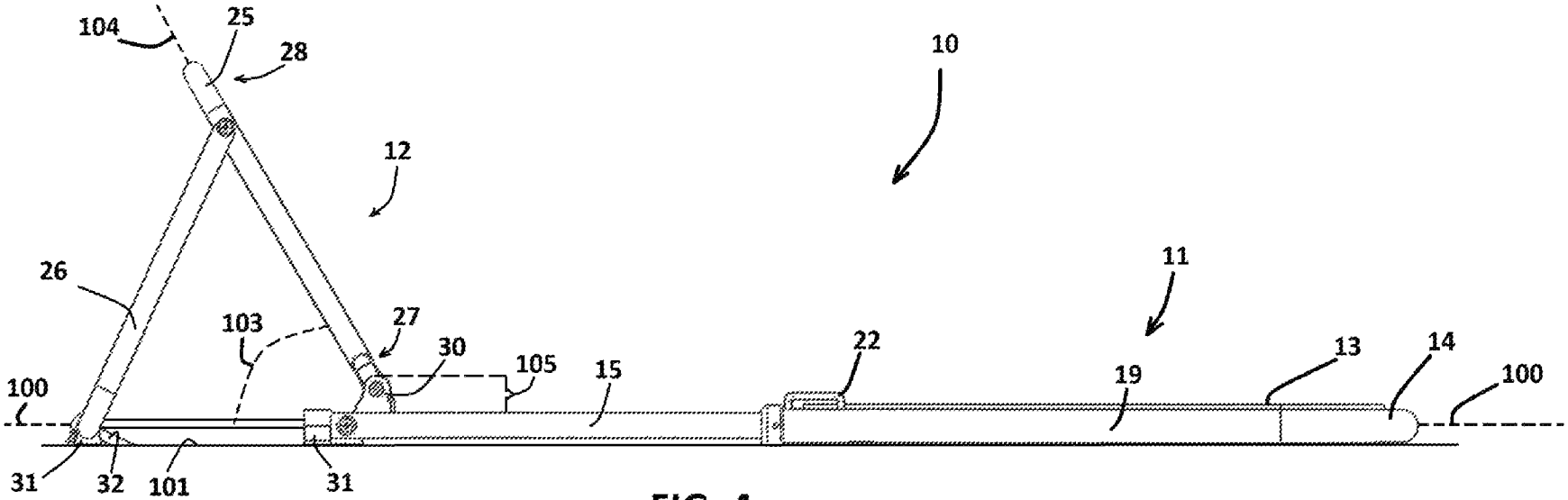
FIG. 4 is a lateral edge elevational view of the glute bridge exercise apparatus according to the present invention shown in the extended first state of use.
Figure 5:
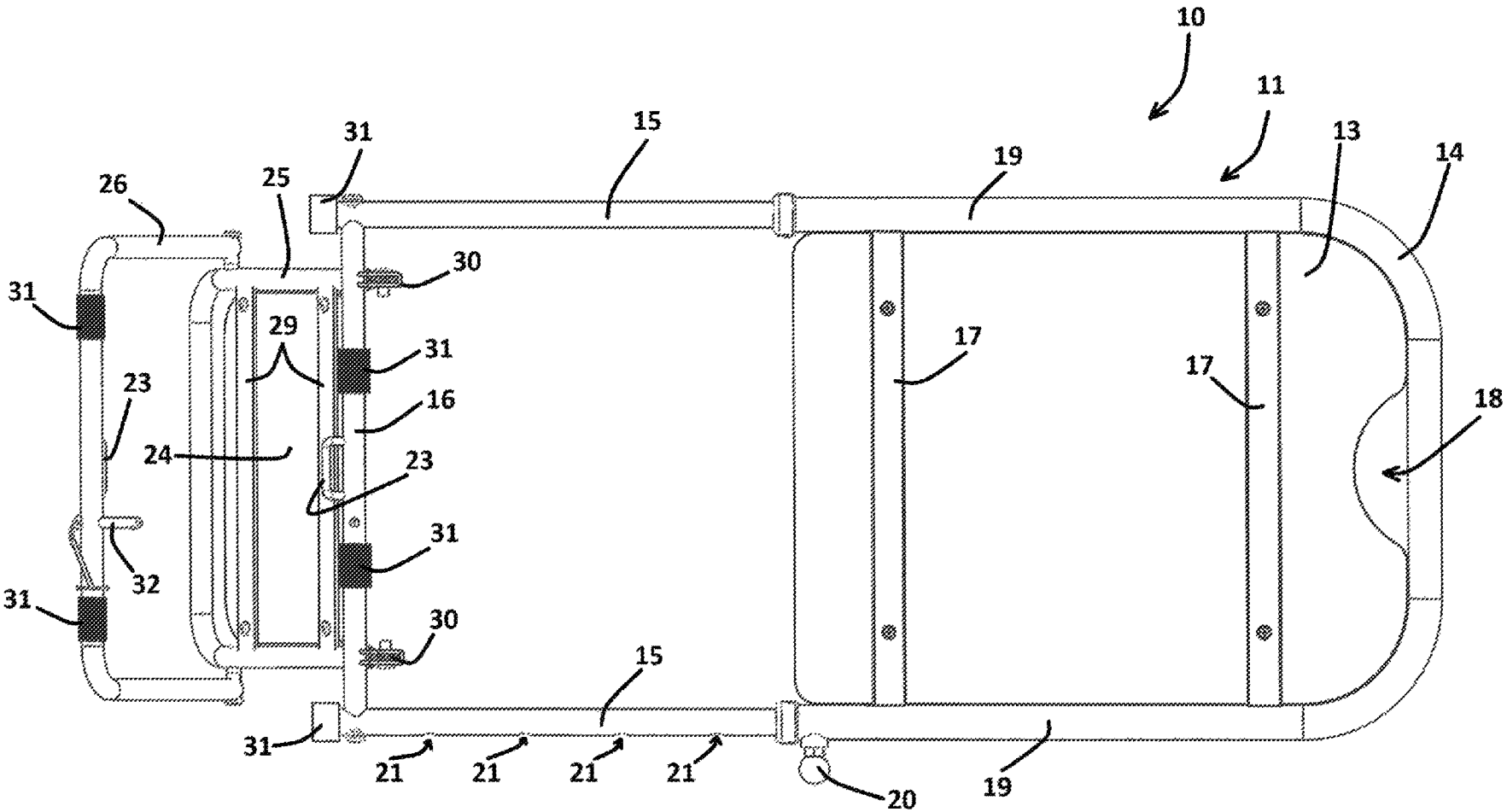
FIG. 5 is a bottom plan view of the glute bridge exercise apparatus according to the present invention shown in the extended first state of use.
Figure 6:
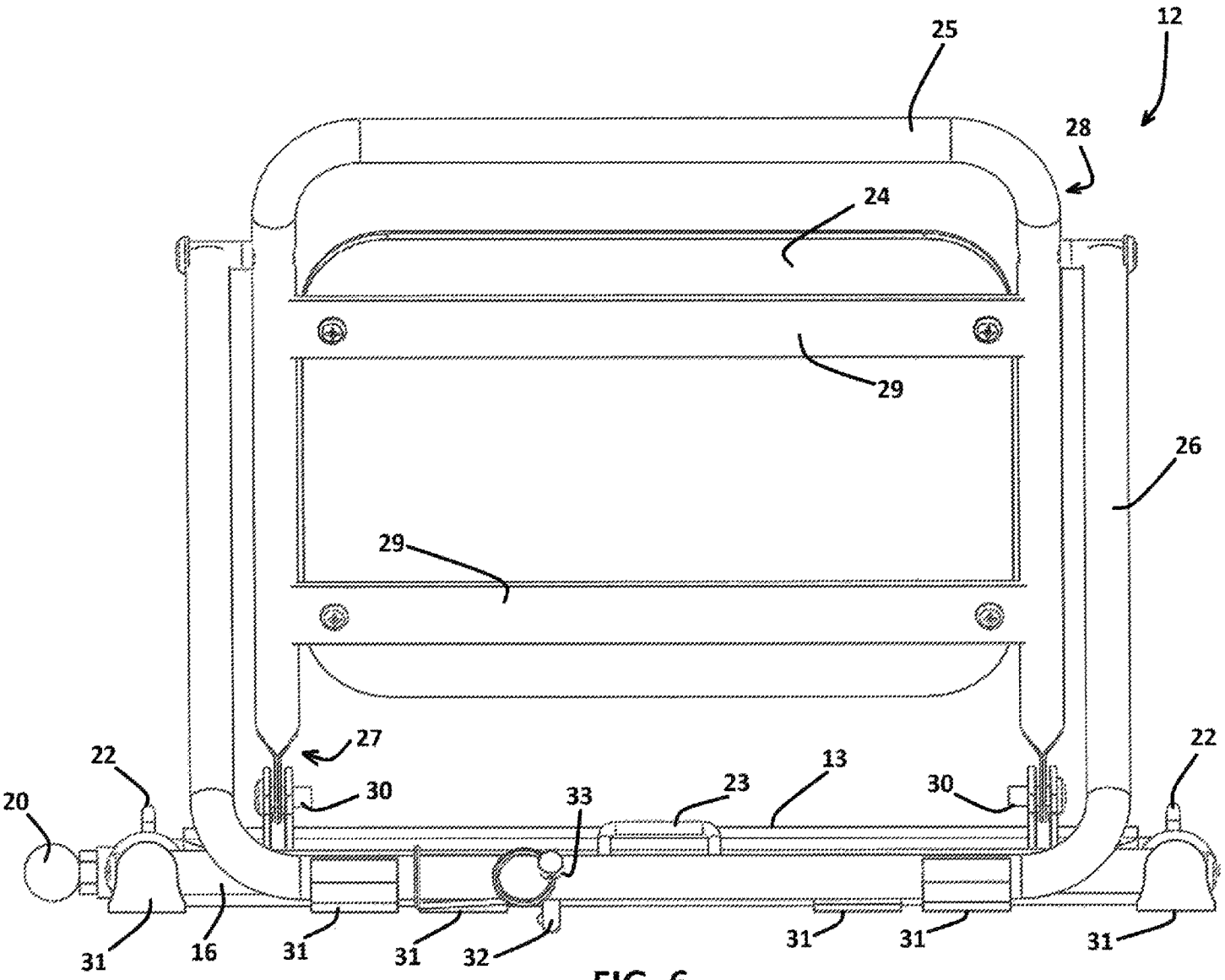
FIG. 6 is a second platform assembly end view of the glute bridge exercise apparatus according to the present invention shown in the extended first state of use.
Figure 7:
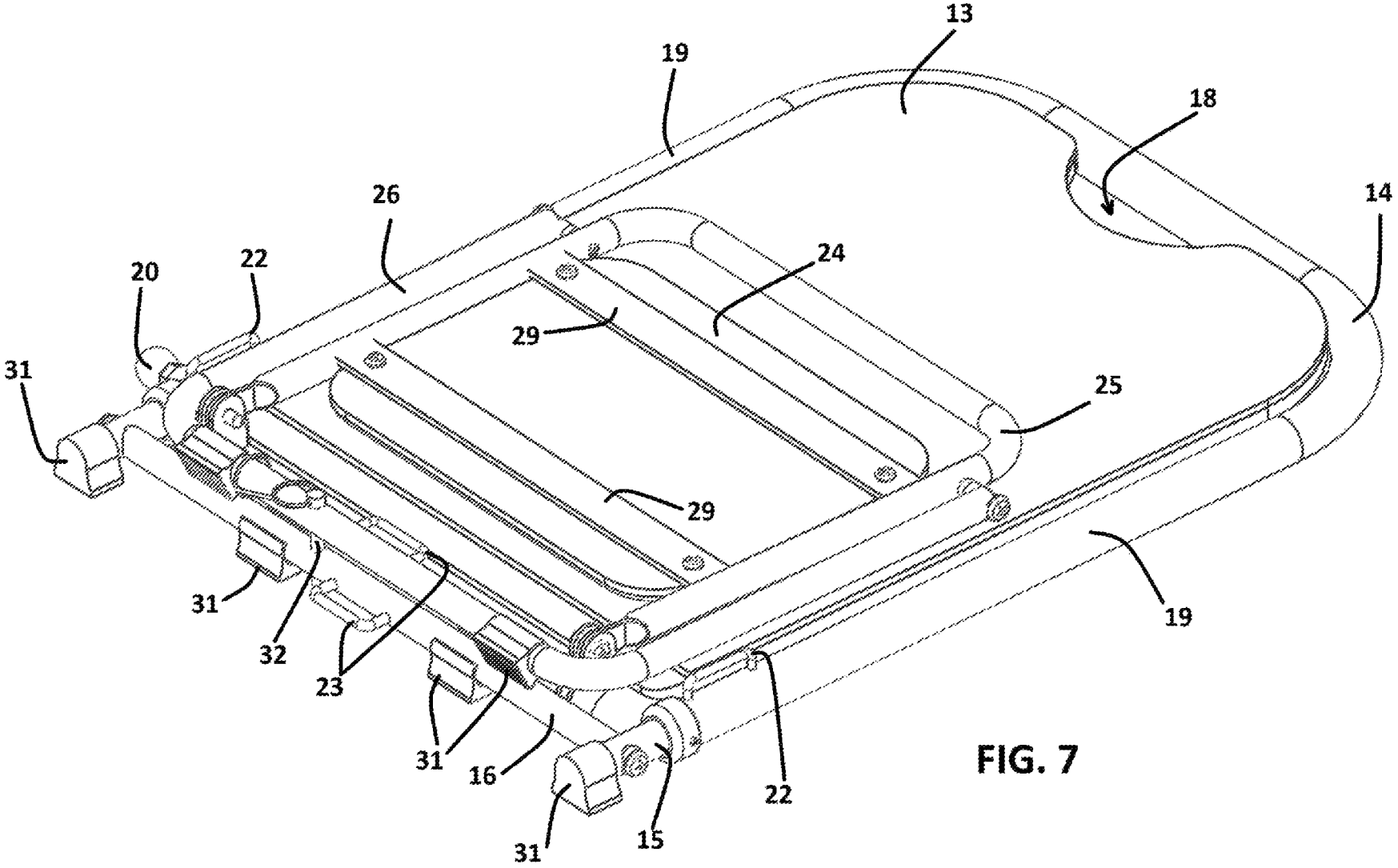
FIG. 7 is a first perspective view of the glute bridge exercise apparatus according to the present invention shown in a folded, collapsed state or configuration for ease of stowage.
Figure 8:
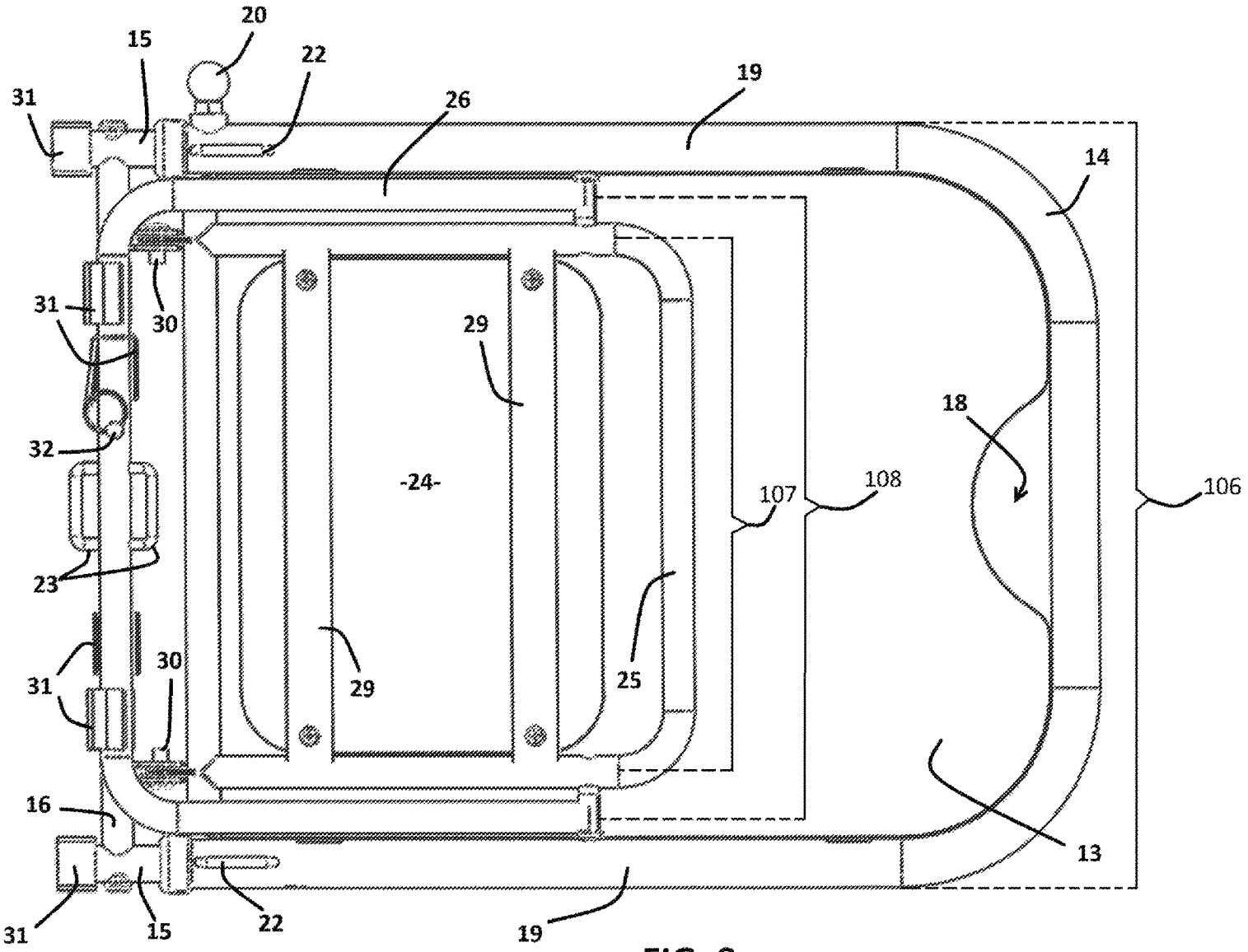
FIG. 8 is a top plan view of the glute bridge exercise apparatus according to the present invention shown in the folded, collapsed state or configuration for ease of stowage.
Figure 9:
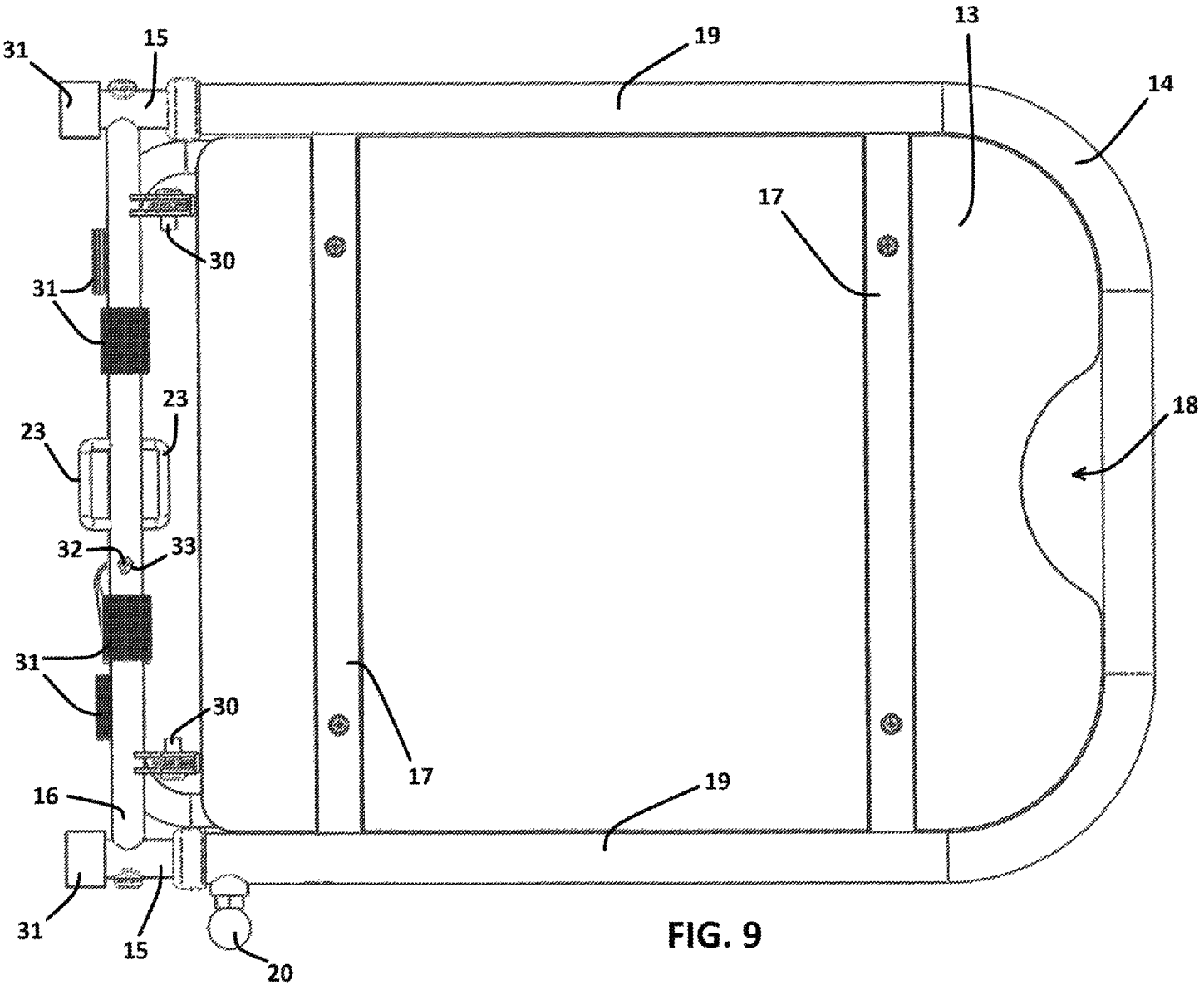
FIG. 9 is a bottom plan view of the glute bridge exercise apparatus according to the present invention shown in the folded, collapsed state or configuration for ease of stowage.
Figure 10:
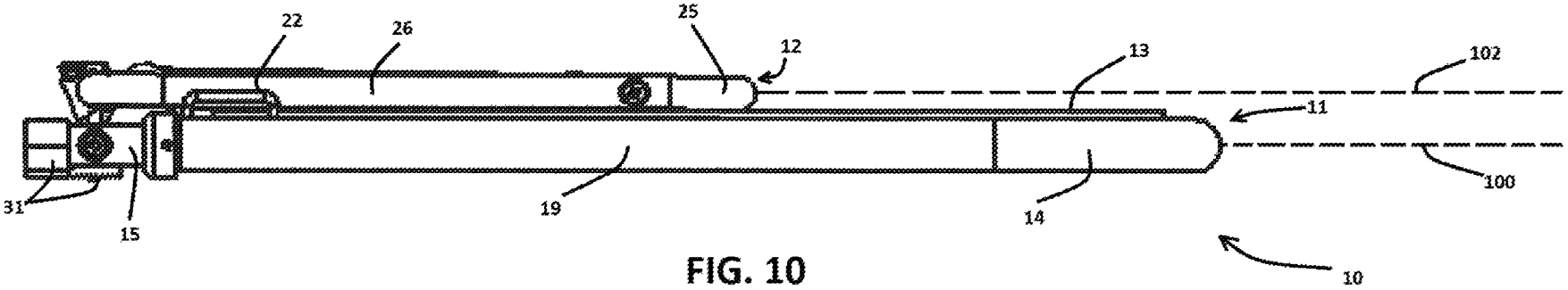
FIG. 10 is a lateral edge view of the glute bridge exercise apparatus according to the present invention shown in the folded, collapsed state or configuration for ease of stowage.

Referring now to the drawings with more specificity, the following specifications generally describe a glute bridge exercise apparatus 10 for enabling a user to variously exercise glute muscle groups and other at-home or on the go exercises and such. The glute bridge exercise apparatus 10 according to the present invention preferably comprises a first platform assembly as at 11 and a second platform assembly as at 12. The second platform assembly 12 is preferably pivotally attached via laterally opposed pivot mechanisms 30 to the first platform assembly 11 via a primary cross member 16 of the first platform assembly 11. The reader will note that the pivot mechanisms 30 have a sufficient height as at 105 to enable the second platform assembly 12 to extend in plane 102 substantially parallel to plane 100 when in a folded, collapsed configuration for stowage or transport as generally and comparatively depicted in FIGS. 4 and 10.

The first platform assembly 11 preferably comprises a first platform portion 13, a first peripheral frame 14 extending about the periphery of the first platform portion 13, a pair of first extension legs 15, the primary cross bar element or cross member 16, and certain secondary cross bar elements or cross members as at 17. The cross member 16 interconnects the pair of first extension legs 15 for stabilizing and maintaining a fixed distance between the pair of first extension legs 15 as telescopically receivable in and extensible from laterally opposed frame portions 19 of the first peripheral frame 14. The crossbar elements 17 similarly interconnect the laterally opposed frame portions 19 of the first peripheral frame 14 for stabilizing and maintaining a fixed distance between the laterally opposed frame portions 19 and further function as support members for the first platform portion 13 for supporting a user thereupon.

The pair of first extension legs 15 are preferably and telescopically receivable in and extensible from the laterally opposed frame portions 19 of the first peripheral frame 14 as comparatively depicted in FIGS. 1-6 versus FIGS. 7-10. The first platform assembly 11 is substantially planar as at plane 100 in FIGS. 4 and 10 and supportable by a horizontal support surface as at 101 as generically depicted and referenced in FIG. 4. The pair of first extension legs 15, primary crossbar or cross member 16, and platform support portion 26 of the second platform assembly 12 may be preferably outfitted with feet elements 31 preferably of a resilient, high friction material exemplified by rubber to prevent movement of the outfitted features relative to the support surface 101.

At least one of the pair of first extension legs 15 preferably comprises a series of pin-receiving apertures as at 21 and at least one of the laterally opposed frame portions 19 of the first peripheral frame 14 is outfitted with a spring-biased pin mechanism as at 20. The pin mechanism 20 is cooperable with the series of pin-receiving apertures 21 for enabling the user to selectively lock the at least one of the pair of first extension legs 15 in a telescopically extended state relative to the at least one of the laterally opposed frame portions 15. Comparatively referencing FIGS. 3 and 5, for example, the reader will there see a total of four exposed pin-receiving apertures 21 with the pin mechanism 20 being received in a fifth (unseen) pin-receiving aperture 21 for locking the extension leg(s) in the maximum telescopically extended state relative to the laterally opposed frame portions 19. The reader will note that any of the series of five pin-receiving apertures 21 may receive the pin mechanism 20 and the second platform assembly 12 may thus be locked at a select distance relative to the first platform assembly 11 (not specifically illustrated) as might be the case when users of different height use the glute bridge exercise apparatus 10.

The second platform assembly 12 preferably comprises a second platform portion 24, a second peripheral frame 25 extending about the periphery of the second platform portion 24, a platform support portion 26, and secondary cross bar elements or cross members as at 29. The second peripheral frame 25 has a proximal frame end as at 27 and a distal frame end as at 28. The proximal frame end 27 is preferably and pivotally attached via pivot mechanisms 30 to the first platform assembly 11 adjacent distal portions of the pair of first extension legs 15, and preferably to the primary cross member 16 extending intermediate the distal portions of the pair of first extension legs 15 thereby forming a singular first pivot axis 110 as generally depicted and referenced in FIG. 3.

The platform support portion 26 is pivotally attached to the distal frame end 28 thereby forming a singular second pivot axis as at 111. The platform support portion 26 enables a user to adjust an angle of inclination 103 of the second platform portion 24 extending in plane 104 relative to the plane 100 of first platform portion 13. The user is thus able to anatomically position portions of the user's body upon the first platform portion 13 (e.g. a user's back) and upon the second platform portion 24 (e.g. a user's feet) for variously exercising glute muscle groups and other exercises as the user may elect. As previously stated, feet elements 31 help prevent movement of the outfitted features relative to the support surface 101 during use.

Further, an adjustable A-frame or second platform assembly support element 39 (e.g. an adjustable strap) may be attached to crossmember-based raised ring features 23 formed on the cross member 16 and the platform support portion 26 to maintain the select angle of inclination 103. In other words, the length of A-frame support member 39 is preferably adjustable to control the pitch of the second platform portion 24 (and plane 104) relative to the plane 100 of the first platform portion 13 as generally and comparatively depicted in FIGS. 2 and 4. The first platform assembly 11 preferably also comprises a pair of laterally opposed raised ring attachment features as at 22, which raised ring attachment features 22 preferably extend upwardly from the first peripheral frame 14 orthogonally relative to the plane 1000 of the substantially planar first platform assembly 11. Resistance bands (not specifically illustrated) may be attached to these laterally opposed raised ring attachment features 22 for aiding the user in increasing or decreasing resistance during glute bridge exercises and the like.

The first peripheral frame 14 comprises a first frame width 106, the second peripheral frame 25 comprises a second frame width as at 107, and the platform support portion 26 comprises a support portion width as at 108. The second frame width 107 is preferably lesser in magnitude than the first frame width 106, and the support portion width 108 is preferably lesser in magnitude than the first frame width 16, but greater than the second frame width 107. These structural arrangements are generally depicted and referenced in FIG. 8 and allow the glute bridge exercise apparatus 10 to be folded into the collapsed configuration for ease of stowage and transport such that the first frame width 106 is a maximum width of the folded, collapsed stowage configuration as there depicted.

The first peripheral frame 14 preferably comprises a first frame length as at 109, the second peripheral frame 25 comprises a second frame length as at 110, and the platform support portion comprises a support portion length as at 111. The second frame length 110 and the support portion length 111 are preferably lesser in magnitude relative to the first frame length 109. These structural arrangements are also generally depicted and referenced in FIG. 8 and allows the glute bridge exercise apparatus 10 to be folded into the collapsed configuration for ease of stowage and transport such that the first frame length 109 is a maximum length of the folded, collapsed stowage configuration as there depicted.

Comparatively referencing FIGS. 1-6 versus FIGS. 7-10 the reader will there consider that the glute bridge exercise apparatus 10 according to the present invention comprises a second platform assembly 12 that is foldable into a substantially planar collapsed configuration and that the substantially planar collapsed configuration of the second platform assembly 12 is restable adjacent the first platform portion 13 when the pair of first extension legs 15 are telescopically received in the opposed portions 19 of the first peripheral frame 14. The first platform assembly 11 and the second platform assembly 12 are thus substantially parallel as at planes 100 and 102 when in the folded, collapsed configuration for enhancing stowability and ease of transport or portability of the glute bridge exercise apparatus 10.

It has been shown that the glute bridge exercise apparatus 10 according to the present invention is preferably foldable and collapsible into a folded, collapsed state or configuration for ease of stowage. In this regard the pivot axes 110 and 111 on the second platform assembly 12 enable the second platform assembly 12 to fold into a substantially planar configuration and the telescopically extensible legs 15 may be received in the laterally opposed portion s19 of the first frame 14 such that the second platform assembly may rest atop the first platform portion 13.

When so configured, the user may more easily carry the glute bridge exercise apparatus 10 via its handle portion 18 that extends intermediate the first platform portion 13 and the first peripheral frame 14 at an upper end of the first platform assembly 11. The handle portion 18, essentially an exaggerated aperture for receiving a user's hand, enables the user to hand carry the glute bridge exercise apparatus 10. A locking pin 32 may be received in pin-receiving apertures 33 formed in the platform support portion 26 and the cross member 16 thereby providing a collapsed configuration locking mechanism to lock the second platform assembly 12 in adjacency to the first platform portion 13 when in the folded, collapsed configuration and preventing the second platform assembly 12 from unfolding during transportation. The glute bridge exercise apparatus 10 according to the present invention may also incorporate the use of various pad attachments to interface between a user's body and parts of the glute bridge exercise apparatus 10 as described, although these elements have not been specifically illustrated.

While the above descriptions contain much specificity, this specificity should not be construed as limitations on the scope of the invention, but rather as an exemplification of the invention. In certain embodiments, the basic invention may be said to essentially teach or disclose a glute bridge exercise apparatus or more simply an exercise apparatus for enabling a user to variously exercise (glute) muscle groups. The glute bridge exercise apparatus according to the present invention may be said to essentially comprise a first platform assembly and a second platform assembly.

The first platform assembly may be said to essentially comprise a first platform portion, a first peripheral frame extending about the periphery of the first platform portion, and a pair of first extension legs. The pair of first extension legs are telescopically receivable in and extensible from laterally opposed frame portions of the first peripheral frame. The second platform assembly may be said to essentially comprise a second platform portion, a second peripheral frame extending about the periphery of the second platform portion, and a platform support portion.

The second peripheral frame has a proximal frame end and a distal frame end. The proximal frame end is pivotally attached to the first platform assembly adjacent the pair of first extension legs. The platform support portion is pivotally attached to the distal frame end and enables a user to adjust an angle of inclination of the second platform portion relative to the first platform portion. The user is able to position portions of his or her anatomy between the first and second platform portions for variously exercising (glute) muscle groups.

The glute bridge exercise apparatus according to the present invention may further preferably comprise a primary cross member of the first platform assembly whereby the cross member interconnects the pair of first extension legs for stabilizing and maintaining a fixed distance between the pair of first extension legs. The proximal frame end of the second peripheral frame is preferably pivotally attached to the cross member of the first platform assembly thereby providing a singular first pivot axis of rotation.

The first peripheral frame preferably comprises a first frame width, the second peripheral frame preferably comprises a second frame width, and the platform support portion preferably comprises a support portion width. The second frame width is lesser in magnitude than the first frame width, the support portion width is lesser in magnitude than the first frame width, but greater in magnitude than the second frame width. The first peripheral frame further preferably comprises a first frame length, the second peripheral frame further preferably comprises a second frame length, and the platform support portion further preferably comprises a support portion length such that the second frame length and the support portion length are each lesser in magnitude than the first frame length. These structural arrangements allow of compact stowage arrangement of the glute bridge exercise apparatus when in the collapsed configuration and further eases portability.

In this last regard, a key feature of the glute bridge exercise apparatus is that the second platform assembly is foldable into a collapsed configuration as generally depicted in FIGS. 7-10. The folded, collapsed configuration of the second platform assembly is restable in adjacency or atop the first platform portion when the pair of first extension legs are telescopically received in the laterally opposed portions of the first peripheral frame. The first and second platform assemblies are substantially parallel to one another when in the collapsed configuration for enhancing stowability of the glute bridge exercise apparatus.

The glute bridge exercise apparatus according to the present invention may further provide at least one extension leg of the pair of first extension legs that comprises a series of pin-receiving apertures and at least one of the laterally opposed frame portions of the first peripheral frame is outfitted with a (spring-biased) pin mechanism. The pin mechanism is cooperable with the series of pin-receiving apertures for enabling the user to selectively lock the at least one of the pair of first extension legs in a telescopically extended state relative to the at least one of the laterally opposed frame portion for selectively distancing the second platform assembly relative to the first platform assembly as for example to accommodate users of differing heights or to vary the distance between opposed support portions for varying exercise support point distancing.

The first platform assembly preferably comprises a pair of laterally opposed raised ring attachment features, the raised ring attachment features extending upwardly from the first peripheral frame orthogonally relative to the substantially planar first platform assembly. The platform support portion and the cross member each also comprise a ring attachment feature. The ring attachment feature of the platform support portion opposes the ring attachment feature of the cross member for enabling the user to interconnect the platform support portion and the cross member for maintaining the angle of inclination of the second platform portion relative to the first platform portion.

The glute bridge exercise apparatus according to the present invention may further preferably comprise a collapsed configuration locking mechanism for locking the second platform assembly in adjacency to the first platform portion when in the collapsed configuration and preventing the second platform assembly from unfolding relative to the first platform assembly during transportation. The collapsed configuration locking mechanism is exemplified by the cooperative associate of the pin 32 and the axially aligned pin-receiving apertures 33 formed in the platform support portion 26 and the cross member 16. The glute bridge exercise apparatus may further preferably comprise a handle portion that extends intermediate the first platform portion and the first peripheral frame at an upper end of the first platform assembly for enabling the user to hand carry the glute bridge exercise apparatus.

Accordingly, although the invention has been described by reference to certain preferred embodiments, and certain associated methodologies, it is not intended that the novel arrangement and methods be limited thereby, but that modifications thereof are intended to be included as falling within the broad scope and spirit of the foregoing disclosures and the appended drawings. Insofar as the description above and the accompanying drawings disclose any additional subject matter that is not within the scope of the claims below, the embodiments are not dedicated to the public and the right to file one or more applications to claim such additional embodiments is reserved.

What is claimed is:

1. A glute bridge exercise apparatus for enabling a user to variously exercise glute muscle groups, the glute bridge exercise apparatus comprising:

a first platform assembly, the first platform assembly comprising a first platform portion, a first peripheral frame extending about a periphery of the first platform portion, and a pair of first extension legs, the pair of first extension legs being telescopically receivable in and extensible from laterally opposed frame portions of the first peripheral frame; and a second platform assembly, the second platform assembly comprising a second platform portion, a second peripheral frame extending about a periphery of the second platform portion, and a platform support portion, the second peripheral frame having a proximal frame end and a distal frame end, the proximal frame end being pivotally attached to the first platform assembly adjacent the pair of first extension legs, the platform support portion being pivotally attached to the distal frame end, the platform support portion enabling a user to adjust an angle of inclination of the second platform portion relative to the first platform portion, the user being positionable between the first and second platform portions for variously exercising glute muscle groups.

2. The glute bridge exercise apparatus of claim 1 wherein the first platform assembly comprises a cross member, the cross member interconnecting the pair of first extension legs for stabilizing and maintaining a fixed distance between the pair of first extension legs.

3. The glute bridge exercise apparatus of claim 2 wherein the first platform assembly comprises a pair of laterally opposed raised ring attachment features, the pair of laterally opposed raised ring attachment features extending upwardly from the first peripheral frame orthogonally relative to the first platform assembly.

4. The glute bridge exercise apparatus of claim 3 wherein the platform support portion and the cross member each comprise a crossmember-based ring attachment feature, the crossmember-based ring attachment feature of the platform support portion opposing the crossmember-based ring attachment feature of the cross member for enabling the user to interconnect the platform support portion and the cross member for maintaining the angle of inclination of the second platform portion relative to the first platform portion.

5. The glute bridge exercise apparatus of claim 2 wherein the proximal frame end is pivotally attached to the cross member of the first platform assembly.

6. The glute bridge exercise apparatus of claim 1 wherein the first peripheral frame comprises a first frame width, the second peripheral frame comprises a second frame width, and the platform support portion comprises a support portion width, the second frame width being lesser than the first frame width, the support portion width being lesser than the first frame width and greater than the second frame width.

7. The glute bridge exercise apparatus of claim 1 wherein the first peripheral frame comprises a first frame length, the second peripheral frame comprises a second frame length, and the platform support portion comprises a support portion length, the second frame length and the support portion length being lesser than the first frame length.

8. The glute bridge exercise apparatus of claim 1 wherein the second platform assembly is foldable into a collapsed configuration, the collapsed configuration of the second platform assembly being restable adjacent the first platform portion, the first and second platform assemblies being parallel in the collapsed configuration for enhancing stowability of the glute bridge exercise apparatus.

9. The glute bridge exercise apparatus of claim 8 comprising a collapsed configuration locking mechanism for locking the second platform assembly in adjacency to the first platform portion when in the collapsed configuration and preventing the second platform assembly from unfolding relative to the first platform assembly during transportation.

10. The glute bridge exercise apparatus of claim 1 wherein at least one of the pair of first extension legs comprises a series of pin-receiving apertures and at least one of the laterally opposed frame portions of the first peripheral frame is outfitted with a pin mechanism, the pin mechanism being cooperable with the series of pin-receiving apertures for enabling the user to selectively lock the at least one of the pair of first extension legs in an telescopically extended state relative to the at least one of the laterally opposed frame portions.

11. The glute bridge exercise apparatus of claim 1 wherein the first platform assembly comprises a handle portion, the handle portion extending intermediate the first platform portion and the first peripheral frame at an upper end of the first platform assembly for enabling the user to hand carry the glute bridge exercise apparatus.

12. An exercise apparatus, the exercise apparatus comprising:

a first platform assembly, the first platform assembly comprising a first platform portion and a pair of first extension legs, the pair of first extension legs being telescopically receivable in and extensible from a first peripheral frame of the first platform assembly, at least one of the pair of first extension legs comprising a series of pin-receiving apertures, the first peripheral frame being outfitted with a pin mechanism, the pin mechanism being cooperable with the series of pin-receiving apertures for enabling a user to selectively lock the at least one of the pair of first extension legs in a telescopically extended state relative to the first peripheral frame; and a second platform assembly, the pair of first extension legs for selectively distancing the second platform assembly from the first platform assembly, the second platform assembly comprising a second platform portion and a platform support portion, the second platform portion being pivotally attached to the first platform assembly, the platform support portion being pivotally attached to the second platform portion, the platform support portion enabling a user to adjust an angle of inclination of the second platform portion relative to the first platform portion, the user being positionable between the first and second platform portions for exercising various muscle groups.

13. The exercise apparatus of claim 12 wherein the first platform assembly comprises a cross member, the cross member interconnecting the pair of first extension legs for stabilizing and maintaining a fixed distance between the pair of first extension legs as telescopically receivable in and extensible from laterally opposed frame portions of the first peripheral frame.

14. The exercise apparatus of claim 13 wherein the platform support portion and the cross member each comprise a crossmember-based ring attachment feature, the crossmember-based ring attachment feature of the platform support portion opposing the crossmember-based ring attachment feature of the cross member for enabling the user to interconnect the platform support portion and the cross member for maintaining the angle of inclination of the second platform portion relative to the first platform portion.

15. The exercise apparatus of claim 12 wherein the second platform assembly is foldable into a collapsed configuration, the collapsed configuration of the second platform assembly being restable adjacent the first platform portion, the first and second platform assemblies being parallel when in the collapsed configuration for enhancing stowability of the exercise apparatus.

16. The exercise apparatus of claim 15 comprising a collapsed configuration locking mechanism for locking the second platform assembly in adjacency to the first platform portion when in the collapsed configuration and preventing the second platform assembly from unfolding relative to the first platform assembly during transportation.

17. The exercise apparatus of claim 12 wherein the first peripheral frame comprises a first frame width, the second platform assembly comprises a second assembly width, and the platform support portion comprises a support portion width, the second assembly width being lesser than the first frame width, the support portion width being lesser than the first frame width and greater than the second assembly width.

* * * * *